US007395981B2

(12) United States Patent
Parham

(10) Patent No.: US 7,395,981 B2
(45) Date of Patent: Jul. 8, 2008

(54) PLUNGER CAN ASSEMBLY

(75) Inventor: Robert L. Parham, Dayton Beach, FL (US)

(73) Assignee: Robert L. Parham and Patricia L. Parham, Trustees, or Their Successors In Trust, Under the Parham Family Trust Dated August 29, 2000, and Any Amendments or Restatements Thereof

( * ) Notice: Subject to any disclaimer, the term of this patent is extended or adjusted under 35 U.S.C. 154(b) by 114 days.

(21) Appl. No.: 11/146,857

(22) Filed: Jun. 7, 2005

(65) Prior Publication Data

US 2006/0273209 A1 Dec. 7, 2006

(51) Int. Cl.
*B02C 9/04* (2006.01)
*B02C 19/00* (2006.01)
*B02C 15/00* (2006.01)

(52) U.S. Cl. ..... 241/121; 241/117

(58) Field of Classification Search ..... 241/117, 241/121

See application file for complete search history.

(56) References Cited

U.S. PATENT DOCUMENTS 3,881,348 A * 5/1975 Morton ..... 73/862.542
4,706,900 A * 11/1987 Prairie et al. ..... 241/121
4,717,082 A * 1/1988 Guido et al. ..... 241/121
4,759,509 A * 7/1988 Prairie ..... 241/121
5,242,123 A * 9/1993 Parham ..... 241/37.5
5,529,253 A * 6/1996 Maillet et al. ..... 241/121
5,538,192 A 7/1996 Parham

* cited by examiner

*Primary Examiner*—Bena Miller
(74) *Attorney, Agent, or Firm*—Merchant & Gould PC; Stanley J. Gradisar

(57) ABSTRACT

A plunger can for a roller assembly within a pulverizing mill has a body which contains a compression spring. A stub shaft transfers the force generated by the compression spring to the roller assembly. A bushing in cooperation with a locking guide in the fore end of the plunger can, along with the stub shaft in an aft end of the plunger can, contains the compression spring there between. The locking guide has an annular flange that fits within an annular channel within the plunger can body. A plurality of extensions spaced around an outside perimeter of the annular flange cooperates with a plurality of extensions around an inside perimeter of the plunger can body such that both sets of extensions clear each other when the locking guide is inserted into the plunger can body. When rotated, the sets of extensions are aligned with each, forming a mechanical lock.

23 Claims, 3 Drawing Sheets

PLUNGER CAN ASSEMBLY

FIELD OF THE INVENTION

This invention pertains to pulverizing mills, and more particularly to the plunger can assembly which contains a mechanical spring suspension system used in such mills.

BACKGROUND OF THE INVENTION

Pulverizing mills are used to pulverize coal, limestone and other solid materials. In the case of coal, gravel sized coal enters the mill and is pulverized into a powder. The powder is carried out of the pulverizing mill by a high velocity air stream and into a furnace where it explosively burns to heat steam which, in an electrical power generator, drives a turbine to generate electricity. Pulverizing mills are designed to operate continuously, except during periods of repair. Examples of these kinds pulverizing mills are described in U.S. Pat. No. 4,705,223 by Dibowski et al.; U.S. Pat. No. 4,694,994 by Henne et al.; U.S. Pat. No. 4,679,739 by Hashimoto et al.; U.S. Pat. No. 4,522,343 by Williams; U.S. Pat. No. 4,491,280 by Bacharach; and U.S. Pat. No. 4,717,082 by Guido et al.

Pulverizing is accomplished by directing the coal onto grinding tables which interface with pulverizing rollers. The rollers are each mounted on a separate roller assembly shaft, and each roller assembly shaft is mounted on a clamshell door in the pulverizing mill. Typically, the grinding table is a disk-shaped structure with an annular groove or raised circumferential edge in the top surface. The grinding table rotates so that the annular groove mates with the rollers. The coal is introduced from the top of the assembly and feeds by gravity to the annular groove where it is pulverized as the grinding table rotates under the rollers. The pulverized coal dust is discharged from the grinding table by a high velocity air flow deflected over the grinding table. The coal dust is redirected through and out of the pulverizing mill by subsequent deflection of the combined flow of air and suspended coal dust particles.

Pulverizing mills may use a rotating grinding table with stationary roller assemblies, as described in U.S. Pat. No. 4,717,082 by Guido et al. (the contents of which are hereby incorporated by reference), and additional examples of these kinds of roller assemblies are described in U.S. Pat. No. 4,996,757 by Parham and U.S. Pat. No. 5,050,810 also by Parham. Alternatively, pulverizing mills may use a stationary grinding table and several rotating roller assemblies. The roller assemblies may also be independently biased against the grinding table so that vibration and shock on one roller will not be transferred to all the other rollers, as described in the Guido et al. '082 patent. The rollers and grinding table are massive. Each roller typically weighs several tons and is on the order of five feet in diameter.

The roller assemblies are biased towards the grinding table by means of compression spring assemblies. Because of the large size of typical pulverizing mills and grinding rollers, compression spring assemblies commonly exert forces within the range of 25,000 to 30,000 PSI. The compression spring assemblies typically are housed in a plunger can structure (sometimes referred to in the art also as a "Journal Spring Housing" or "Spring Housing" as a constituent part of a "Mechanical Spring System") which is suitably mounted so as to cooperate with the roller assembly. A typical plunger can structure houses several elements, including a compression spring assembly, a plunger assembly which transfers the force generated by the compression spring to the roller element of the roller assembly, and a plunger bearing assembly, all of which are well known in the art (the plunger assembly is sometimes referred to in the art as a "Stud Assembly" or "Preload Stud Assembly"). Examples of these kinds of plunger can structures and the assemblies housed therein are described in U.S. Pat. No. 3,881,348 by Morton; U.S. Pat. No. 4,706,900 by Prairie, et al.; and U.S. Pat. No. 4,759,509 by Prairie.

The plunger can structure itself, as well as the compression spring assembly, the plunger assembly, the plunger bearing assembly, and all of the interfacing and other elements of each assembly contained within the plunger can, are exposed to extreme conditions. The massive grinding table with which the roller assemblies cooperate typically revolve at 200 to 300 revolutions per minute. The pulverizing mills within which many of the plunger cans are installed operate at temperatures between 600 to 700 degrees Fahrenheit. In addition, the mills occasionally catch fire. Such fires are frequently smothered with steam and then cooled, resulting in large and fast temperature changes within the pulverizing mills. There is also the constant presence of pulverized coal dust particles throughout the pulverizing mills. Carried by high speed air flow, the coal particles in motion create the effect of a continuous sand-blasting on all component structures within the interior of the pulverizing mill.

The existing multi-part fabricated plunger can structure, cooperating with its several multi-part assemblies and interfacing elements under the extreme conditions of the pulverizing mill, is a source of a number of costly problems. These problems affect both the fabricated plunger can structure and the assemblies it houses. One problem is that the fabricated plunger can wears out or one or more of the multiplicity of parts comprising it wears out. Such wear in the fabricated plunger can is a product of vibration, abrasion, and shock, and is accentuated by differential shrinkage and expansion of its various elements in reaction to heating and cooling within the pulverizing mill. Stress cracks and fractures are not uncommon in the fabricated plunger can structure. So also, and by similar causes, the compression spring assembly, plunger assembly, plunger bearing assembly and interfacing elements contained within the fabricated plunger can structure experience structural degradation, deterioration, misalignment and wear. Other degradation to the assemblies is caused by the cumulative blasting effect and deposit over time, and consequent caking of, coal dust particles around the elements of such assemblies.

Repairing the existing fabricated plunger can structures themselves, and opening them so as to inspect, clean, adjust, or repair or replace the compression spring assembly, plunger assembly, plunger bearing assembly, and interfacing elements contained within them presents other difficulties. The compression spring in the plunger can typically is under twenty to thirty thousand pounds or more of pressure. The top tends to explode off the can like a bomb when it is removed, thereby endangering any workmen in the immediate surroundings. Also, the existing fabricated plunger can structures must be removed from the pulverizing mill for opening off site. This requires extensive labor and consumes valuable time. The pulverizing mill cannot operate during that time, and the down time imposes a cost of many thousands of dollars per day. Electric utilities must either pass that cost on to rate payers or else absorb it so as to suffer diminished rates of return to their shareholders. An improved plunger can assembly addressing these concerns is described in U.S. Pat. No. 5,242,123 by Parham.

Moreover, wear and degradation to the plunger can structure and to the assemblies housed within it adversely affect the massive roller assemblies of the pulverizing mill. In particular, the wear rate of the roller assemblies is sensitive, not only to the depth, hardness and uniform size and consistency of the coal, but also to the amount and uniformity of the countervailing force applied to the rollers by the compression spring and other assemblies housed within the plunger can structure. The cost of repairing or replacing the rollers is very high in relation to the cost of repairing or replacing the plunger can structures and any of the assemblies contained therein.

One particularly formidable problem presented by plunger can structures relates to the interface between the plunger can and the roller assemblies. In some pulverizing mills, the plunger tip rides on the roller assembly to provide a biasing force urging the roller assembly down onto the grinding table to grind the coal. As the rollers wear, however, more play is introduced into the system as the compression spring expands in response to the roller wear. Because the force exerted by the compression spring against the plunger tip, and consequently by the plunger tip against the roller assembly, is proportional to the spring compression, this expansion of the compression spring reduces this force. As the roller wear continues, the force reduction, which results in less pulverizing effect, becomes unacceptable. At that point, it is necessary to place a shim between the plunger tip and the roller assembly to take up the play resulting from the roller wear to bring the force exerted by the plunger tip on the roller assembly back up to the desired level.

This shimming operation is time consuming, which results in high labor costs and expensive mill down-time. It is generally necessary to open the clamshell doors to the mill on which the plunger assembly is mounted, apply the necessary shims, and then close the clamshell doors. The opening and closing of the clamshell doors is an elaborate and dangerous procedure.

DETAILED DESCRIPTION OF THE INVENTION

Figure 1:
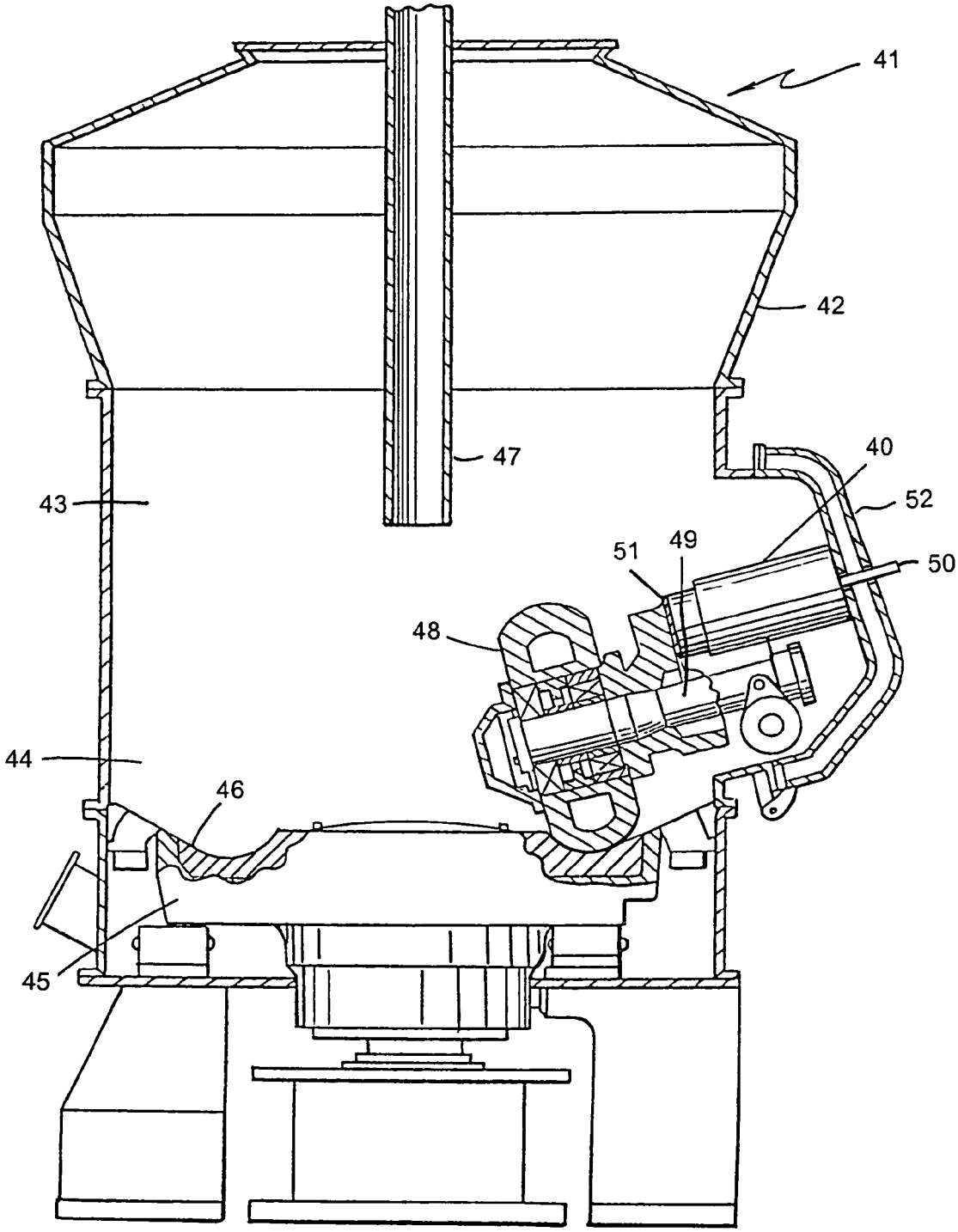
FIG. 1 PRIOR ART
FIG. 1 shows a side view, partially in section, of a typical prior art pulverizing mill.

Referring now to the Figures, in which like reference numerals and names refer to structurally and/or functionally similar elements thereof, FIG. 1 shows a side view, partially in section, of a typical prior art pulverizing mill. Referring now to FIG. 1, a typical coal Pulverizing Mill 41 which is well known in the art is shown. The Pulverizing Mill 41 has an Outer Housing 42 including an Upper Portion 43 and a Lower Portion 44. In Lower Portion 44, there is a Grinding Table 45 with an Annular Groove 46 on an upper surface. A set of three Roller Assemblies 48 (only one shown in FIG. 1) mate with Annular Groove 46 in the upper surface of Grinding Table 45. Each of the Roller Assemblies 48 rotates on the end of its own Roller Assembly Shaft 49. Each Roller Assembly 48 has a Plunger Can Structure 40 cooperatively associated with it. Each Plunger Can Structure 40 houses several assemblies which are operative to establish a mechanical spring suspension system working on each of the associated Roller Assemblies 48. Each Plunger Can Structure 40 is joined to a separate Clamshell Door 52 in Outer Housing 42 to which its associated Roller Assembly 48 is joined. Shim Plate 51 is located between the tip of Plunger Can Structure 40 and Roller Assembly 48 to take up the play resulting from wear to bring the force exerted by the tip of Plunger Can Structure 40 on the load of Roller Assembly 48 back up to a desired level. Shim Plate 51 may be attached in a conventional manner by bolts, welding, or otherwise to Roller Assembly 48. Shim Plate 51 attached to Roller Assembly 48 transfers the force of a compression spring housed within Plunger Can Structure 40 to the load of Roller Assembly 48. Indicator Rod 50, typically made of stainless steel, is threaded into one end of the tip of Plunger Can Structure 40 so as to protrude out of the opposite end.

Coal lumps up to about two inches in diameter are introduced into Pulverizing Mill 41 through a Coal Pipe 47 in the Upper Portion 43. The coal falls downward onto the Grinding Table 45 and into Annular Groove 46. Grinding Table 45 rotates so that Annular Groove 46 passes under Roller Assemblies 48. Roller Assemblies 48 are biased towards Annular Groove 46 by operation of Plunger Can Structures 40. Alternatively, Roller Assemblies 48 may be driven independently by suitable motors in conjunction with a stationary grinding table (not shown). The present invention replaces Plunger Can Structure 40 and would be equally applicable to a pulverizing mill in which the roller assemblies turn around a center housing and the grinding table is stationary, and to a pulverizing mill with a rotating grinding table and stationary roller assemblies. A more detailed description of the nature of the construction and mode of operation of the Pulverizing Mill 41 is contained in the Guido et al. '082 patent and the Prairie '509 patent previously referenced.

Figure 2:
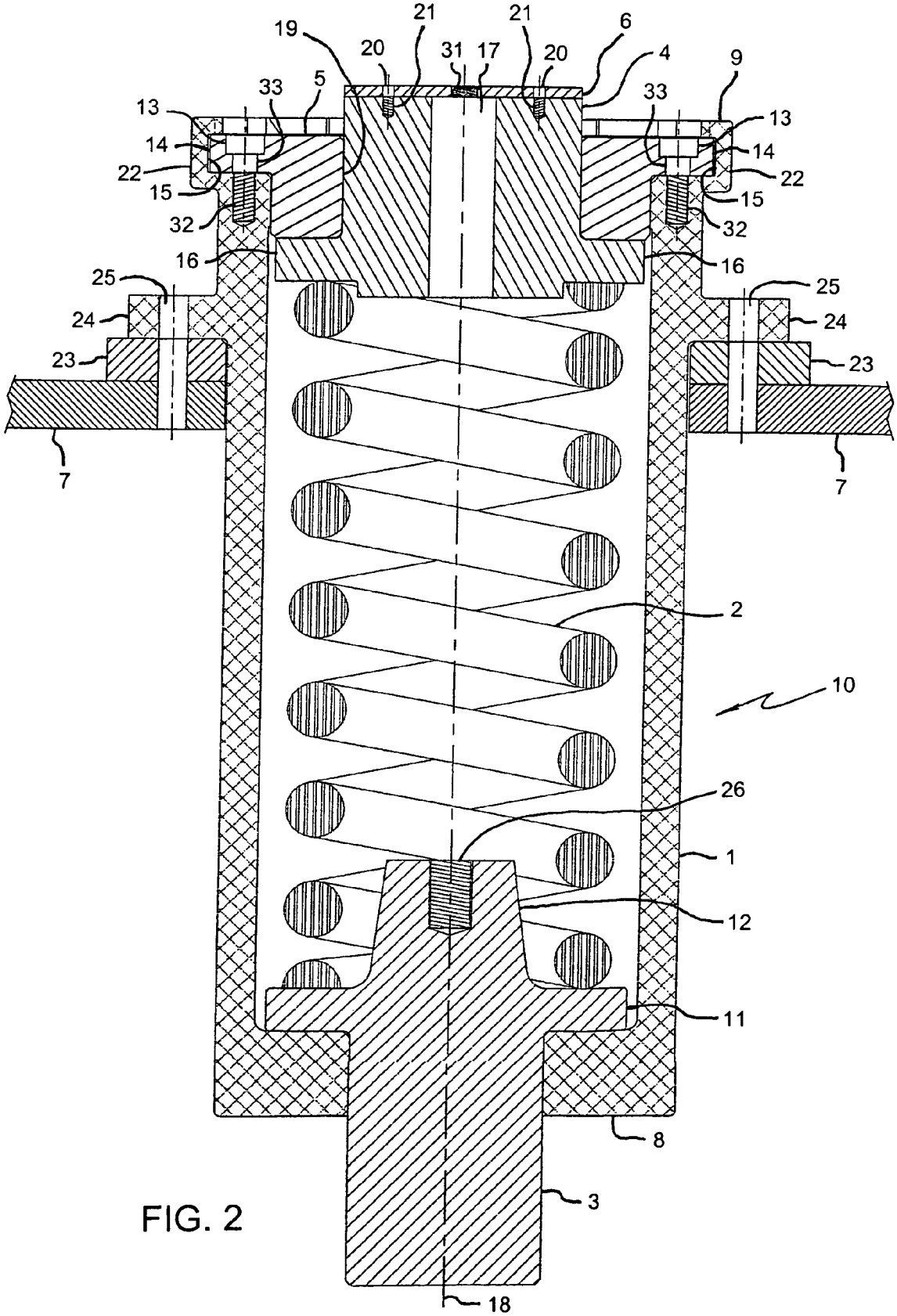
FIG. 2 shows a side sectional view of the plunger can in an embodiment of the present invention.

FIG. 2 shows a side sectional view of the plunger can in an embodiment of the present invention. Referring now to FIG. 2, Plunger Can 10 comprises a Plunger Can Body 1 which is typically, but not necessarily, cast. Plunger Can Body 1 is generally cylindrical in shape and hollow, and houses the following major components: Compression Spring 2, Stub Shaft 3, Plunger Can Bushing 4, and Locking Guide 5. Stub Shaft 3 is seated in Aft End 8 of Plunger Can Body 1 so that a portion of Stub Shaft 3 protrudes out of Aft End 8. Plunger Can Bushing 4 and Locking Guide 5 are mounted within Fore End 9 of Plunger Can Body 1. Plunger Can 10 is mounted to a pulverizing mill through an opening in Pulverizer Door 7, which is a single-wall design as opposed to a double-wall design as shown in FIG. 1. A circular Stiffening Ring 23 encircles the opening and is welded to Pulverizer Door 7, and lies between Pulverizer Door 7 and First Annular Flange 24 of Plunger Can Body 1. A plurality of Bores 25 through Pulverizer Door 7, Stiffening Ring 23, and First Annular Flange 24 are aligned with each other and spaced circumferentially around First Annular Flange 24, Stiffening Ring 23 and Pulverizer Door 7. A plurality of nuts and bolts (not shown) through said plurality of Bores 25 are used to secure Plunger Can 10 to Stiffening Ring 23 and Pulverizer Door 7.

Stub Shaft 3 includes Annular Flange 11 on the end of Stub Shaft 3 that is within Plunger Can Body 1. Annular Flange 11 serves as a stop to limit the extent to which Stub Shaft 3 can extend out of Aft End 8 of Plunger Can Body 1. On the inner end of Stub Shaft 3 is Hub 12 which snugly receives an aft end of Compression Spring 2. Compression Spring 2 housed within Plunger Can 10 is designed to encircle Hub 12 at one end and is itself, encircled by and contained within Plunger Can Body 1. Stub Shaft 3 bears the load of a roller assembly as shown in FIG. 1, and in response to the load, will translate back and forth within Plunger Can Body 1 as Compression Spring 2 expands and contracts in response to the load.

Locking Guide 5 is likewise encircled by and attached to Plunger Can Body 1 at Fore End 9. Locking Guide 5 is affixed to Plunger Can Body 1 by a plurality of Bolts 13 spaced around Annular Lip 14 of Locking Guide 5. A plurality of Threaded Bores 32 in Plunger Can Body 1 receive the threaded end of a plurality of Bolts 13 after passing through a plurality of Bores 33 spaced circumferentially around Annular Lip 14. Annular Channel 15 within Second Annular Flange 22 of Plunger Can Body 1 receives Annular Lip 14 of Locking Guide 5 in the manner described below in the description of FIGS. 3A and 3B. Locking Guide 5 also has a Center Bore 19 which receives Plunger Can Bushing 4 there through.

Blanking Plate 6 is attached to Plunger Can Bushing 4 via a plurality of bolts (not shown) that pass through a plurality of Bores 20 in Blanking Plate 6 and engage with Threaded Bores 21 in Plunger Can Bushing 4. Blanking Plate 6 serves a two-fold purpose. First, Tap Hole 31 in the center of Blanking Plate 6 allows a sealer to be injected into the interior of Plunger Can 10 to maintain a positive pressure to ensure that coal dust does not migrate back into the interior of Plunger Can 10. Second, should Stub Shaft 3 need to be adjusted, or manipulated to test for a broken Compression Spring 2, or replaced due to wear, Blanking Plate 6 is removed and a rod (not shown) is inserted through Center Bore 17 of Plunger Can Bushing 4. The rod is threaded on the inserted end, and engages with Threaded Bore 26 in Hub 12 in order to manipulate or retrieve Stub Shaft 3. Prior art plunger can structures have a rod in place at all times, even during operation of the pulverizing mill. The present invention inserts the rod into Plunger Can Body 1 only when there is a need to manipulate or retrieve Stub Shaft 3, or replace Compression Spring 2, or some other reason. With the present invention, Stub Shaft 3 can be removed without having to unbolt Plunger Can Body 1 from Pulverizer Door 7.

Plunger Can Bushing 4 includes an Annular Flange 16 on the end of Plunger Can Bushing 4 that is within Plunger Can Body 1. Annular Flange 16 serves as a stop to limit the extent to which Plunger Can Bushing 4 can extend through Locking Guide 5 and out of Fore End 9 of Plunger Can Body 1. The inner end of Plunger Can Bushing 4 snugly receives a fore end of Compression Spring 2. Plunger Can Bushing 4 also has Center Bore 17 along Central Axis 18 which runs through the center of Plunger Can Bushing 4.

Plunger Can Body 1 may be fabricated from a single casting of steel in accordance with processes known in the art to achieve a unitary structure having a tensile strength around 120,000 PSI. Variable and uneven wear on any Plunger Can 10 mounted in a pulverizing mill is expected due to the sand blasting effect of pulverized coal dust particles suspended in the high velocity air flow throughout the pulverizing mill (accounting for wear), combined with the unique air flow patterns characteristic of every different pulverizing mill (accounting for the variability of the wear from mill to mill, and for the unevenness of wear along the length of a Plunger Can 10 within any one mill). Since this uneven wear is frequently found to result in greater wear on different outer portions of the Plunger Can 10 in any given pulverizing mill, a counterbalancing thickening at the wear regions may serve to improve the durability of Plunger Can 10. Thus, Plunger Can Body 1 of the present invention may be variably thickened in one or more regions to combat wear associated with a particular pulverizing mill (not shown in FIG. 2).

Stub Shaft 3 is positioned inside Plunger Can 10 which is then loaded with Compression Spring 2. Locking Guide 5, with Plunger Can Bushing 4 seated therein, is placed into position on top of Compression Spring 2. The loading of the Plunger Can 10 is completed by operation of a spring compressor assembly (not shown) which is temporarily attached to Plunger Can Body 1, all as described in some detail in above-referenced U.S. Pat. No. 5,242,123 by Parham. Appropriate rotation of the lug nut of the ball shaft of the spring compressor assembly causes Plunger Can Bushing 4 to be pushed into Plunger Can Body 1, thereby compressing the Compression Spring 2 and as further described in relation to FIGS. 3A and 3B below.

Figure 3B:
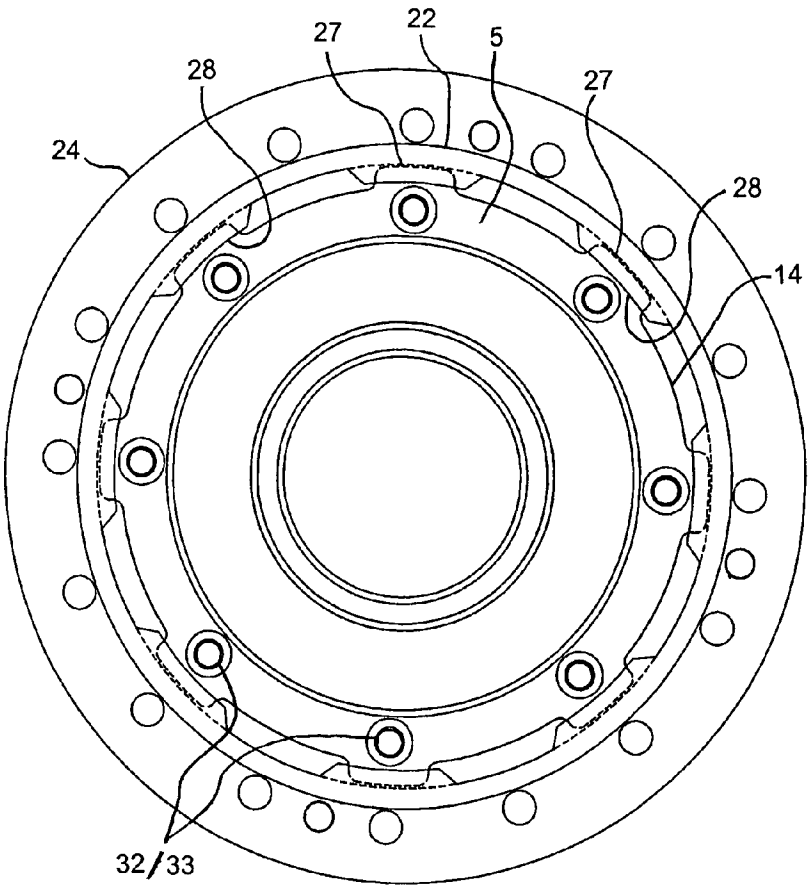
FIG. 3B shows a top view of the locking guide in the locked position in relation to the plunger can in an embodiment of the present invention.
Figure 3A:
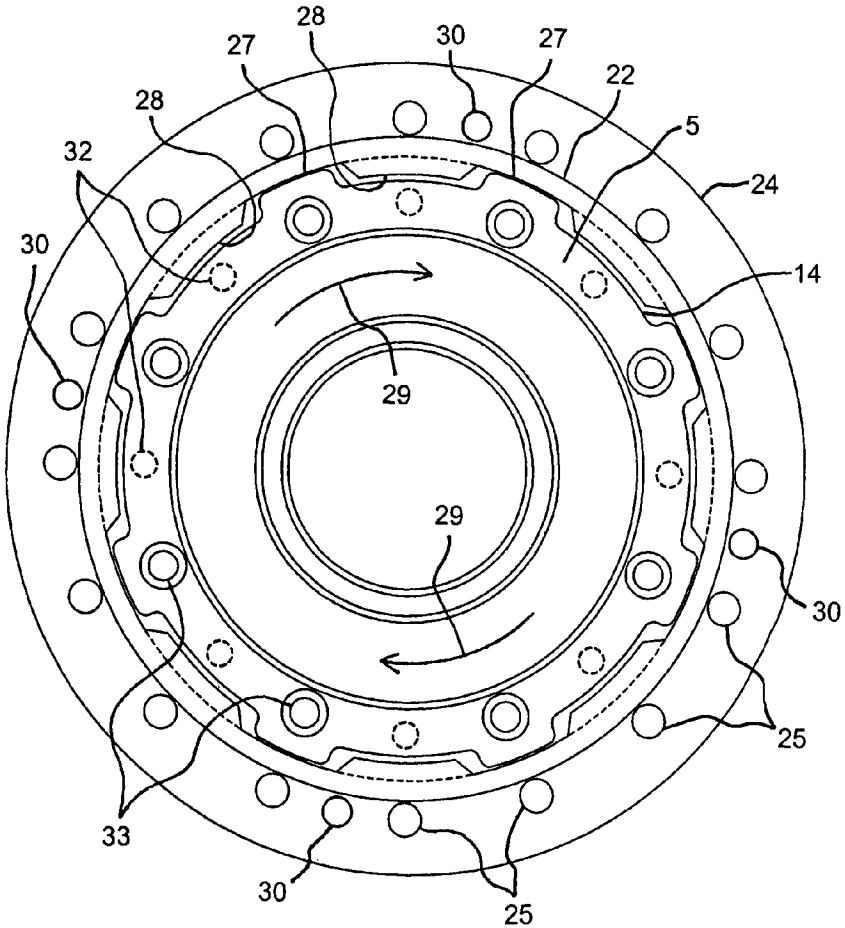
FIG. 3A shows a top view of the locking guide in the unlocked position in relation to the plunger can in an embodiment of the present invention.

FIG. 3A shows a top view of the locking guide in the unlocked position in relation to the plunger can in an embodiment of the present invention, and FIG. 3B shows a top view of the locking guide in the locked position in relation to the plunger can in an embodiment of the present invention. Referring now to FIG. 3A, with Compression Spring 2 compressed by the spring compressor assembly, the Locking Guide 5 is positioned within Annular Channel 15 which is formed on the interior of Second Annular Flange 22 of Plunger Can Body 1. Annular Lip 14 located on a top side of Locking Guide 5 has a plurality of Outward Extensions 27 of a first width spaced equidistantly around its outside perimeter and separated from one another by a second width greater than the first width in a gear-tooth like manner. Similarly, Second Annular Flange 22 of Plunger Can Body 1 has a plurality of Inward Extensions 28 on its top side of a third width spaced equidistantly around its inside perimeter and separated from one another by a fourth width less than the third width, also in a gear-tooth like manner. The first width of Outward Extensions 27 are less than the fourth width which separates Inward Extensions 28, and the third width of Inward Extensions 28 is less than the second width which separates Outward Extensions 27. In addition, there is clearance between the largest diameter of Annular Lip 14 of Locking Guide 5 measured at the Outward Extensions 27, and the inside diameter of Annular Channel 15 of Second Annular Flange 22 measured at the fourth width between Inward Extensions 28. Thus, Locking Guide 5 is positioned within Plunger Can Body 1 such that Outward Extensions 27 are aligned with the spaces between Inward Extensions 28, and Inward Extensions 28 are aligned with the spaces between Outward Extensions 27, so that Outward Extensions 27 and Inward Extensions 28 are offset from each other and there is clearance there between.

Referring now to FIG. 3B, there is also clearance between Annular Lip 14 of Locking Guide 5 and Annular Channel 15 of Second Annular Flange 22 such that Locking Guide 5 is free to rotate about Central Axis 18 within Second Annular Flange 22. In FIG. 3B, Locking Guide 5 has been rotated about Central Axis 18 in the direction indicated by Arrows 29 so that Outward Extensions 27 of Locking Guide 5 are positioned under Inward Extensions 28 of Second Annular Flange 22 of Plunger Can Body 1 forming a mechanical lock. In this locked position, the spring compressor assembly may be removed and Compression Spring 2 will be contained within Plunger Can Body 1 because of the mechanical lock. Typically, however, a plurality of Bolts 13 are first passed through Bores 33 and into Threaded Bores 32, which are now aligned together after the rotation of Locking Guide 5 about Central Axis 18, and Bolts 13 are tightened, thus doubly securing Locking Guide 5 to Plunger Can Body 1. Locking Guide 5 may also be rotated about Central Axis 18 in the direction opposite to that indicated by Arrows 29 to achieve the locked position.

Threaded Jack Bolt Bores 30 extend through First Annular Flange 24. If Plunger Can 10 becomes difficult to remove from Stiffening Ring 23/Pulverizer Door 7, jacking bolts (not shown) can be threaded into Threaded Jack Bolt Bores 30 and turned to bear down on Stiffening Ring 23 in order to break Plunger Can 10 loose. Once all of the nuts and bolts are removed from Bores 25, a crane can lift Plunger Can 10 up and out of Pulverizer Door 7 to affect repairs, replacement, etc.

Having described the present invention, it will be understood by those skilled in the art that many changes in construction and widely differing embodiments and applications of the invention will suggest themselves without departing from the scope of the present invention.

What is claimed is:

1. A plunger can assembly for a pulverizing mill, comprising:

a plunger can body having a fore end, an aft end, and a central axis there between;

a stub shaft seated in said aft end of said plunger can body such that a portion of said stub shaft protrudes out of said aft end and bears a load;

a locking guide secured in said fore end of said plunger can body, said locking guide having a center bore;

a plunger can bushing received through said center bore of said locking guide such that a portion of said plunger can bushing protrudes out of said fore end of said plunger can body;

a compression spring contained within said plunger can body and received between said stub shaft and said plunger can bushing, wherein said compression spring applies a force to said stub shaft which translates back and forth in a direction along said central axis in response to said load;

an annular flange approximate to said fore end, wherein said annular flange seats against a stiffening ring which encircles an opening in a pulverizer door of the pulverizing mill;

a plurality of bores through said annular flange, said stiffening ring, and said pulverizer door that are aligned with each other and spaced circumferentially around said annular flange, said stiffening ring, and said pulverizer door; and a plurality of nuts and bolts through said plurality of bores which secure said annular flange of said plunger can body to said stiffening ring and said pulverizer door.

2. The plunger can assembly according to claim 1 wherein said plunger can body is hollow and cylindrical in shape.

3. The plunger can assembly according to claim 1 wherein said stub shaft further comprises:

an annular flange, located on a portion of said stub shaft that is within said plunger can body, which serves as a stop to limit the extent to which said stub shaft can extend out of said aft end of said plunger can body; and a hub above said annular flange on said portion of said stub shaft that is within said plunger can body which snugly receives an aft end of said compression spring.

4. The plunger can assembly according to claim 3 wherein said stub shaft further comprises:

a threaded bore in said hub.

5. The plunger can assembly according to claim 4 wherein said plunger can bushing further comprises:

an annular flange on an end of said plunger can bushing that is within said plunger can body which serves as a stop to limit the extent to which said plunger can bushing can extend through said locking guide and out of said fore end of said plunger can body, wherein said annular flange snugly receives a fore end of said compression spring; and a center bore there through.

6. The plunger can assembly according to claim 5 further comprising:

a blanking plate that attaches to said portion of said plunger can bushing that protrudes out of said fore end of said plunger can body through a plurality of bolts that pass through a plurality of bores in said blanking plate and engage with a plurality of threaded bores in said plunger can bushing, said blanking plate further comprising:

a tap hole in a center of said blanking plate, wherein said tap hole allows a sealer to be injected into an interior of said plunger can body in order to maintain a positive pressure within said plunger can body.

7. The plunger can assembly according to claim 6 further comprising:

a rod for manipulating or retrieving said stub shaft, said rod having a threaded end, wherein said blanking plate is removed and said threaded end of said rod is inserted through said center bore of said plunger can bushing and engaged with said threaded bore of said stub shaft, wherein said stub shaft may be manipulated or removed with said rod without having to remove the plunger can assembly from said pulverizer door.

8. A plunger can assembly for a pulverizing mill, comprising:

a plunger can body having a fore end, an aft end, and a central axis there between;

a stub shaft seated in said aft end of said plunger can body such that a portion of said stub shaft protrudes out of said aft end and bears a load;

a locking guide secured in said fore end of said plunger can body, said locking guide having a center bore;

a plunger can bushing received through said center bore of said locking guide such that a portion of said plunger can bushing protrudes out of said fore end of said plunger can body;

a compression spring contained within said plunger can body and received between said stub shaft and said plunger can bushing, wherein said compression spring applies a force to said stub shaft which translates back and forth in a direction along said central axis in response to said load;

an annular flange at said fore end having an annular channel formed interior to said annular flange, and having a plurality of inward extensions on a top side of said annular flange that are spaced equidistantly around an inside perimeter of said annular flange.

9. The plunger can assembly according to claim 8 wherein said locking guide further comprises:

an annular lip located on a top side of said locking guide having a plurality of outward extensions on a top side of said annular lip that are spaced equidistantly around an outside perimeter of said annular lip, wherein in an unlocked position, said annular lip of said locking guide fits with clearance within said annular channel, and said plurality of outward extensions and said plurality of inward extensions are offset from each other with clearance; and a plurality of bores spaced circumferentially around said annular lip.

10. The plunger can assembly according to claim 9 wherein said plunger can body further comprises:

a plurality of threaded bores in said fore end of said plunger can body, wherein when said locking guide is rotated about said central axis from said unlocked position to a locked position, said plurality of outward extensions are positioned under said plurality of inward extensions forming a mechanical lock, and said plurality of threaded bores align with said plurality of bores in said annular lip.

11. The plunger can assembly according to claim 10 further comprising:

a plurality of bolts for securing said locking guide to said plunger can body, wherein said plurality of bolts pass through said plurality of bores in said annular lip and into said plurality of threaded bores in said plunger can body and tightened.

12. A plunger can assembly for a pulverizing mill, comprising:

a plunger can body having a fore end, an aft end, and a central axis there between;

a stub shaft seated in said aft end of said plunger can body such that a portion of said stub shaft protrudes out of said aft end and bears a load;

a locking guide secured in said fore end of said plunger can body, said locking guide having a center bore;

a plunger can bushing received through said center bore of said locking guide such that a portion of said plunger can bushing protrudes out of said fore end of said plunger can body;

a compression spring contained within said plunger can body and received between said stub shaft and said plunger can bushing, wherein said compression spring applies a force to said stub shaft which translates back and forth in a direction along said central axis in response to said load;

wherein said plunger can body is bolted to the pulverizing mill through a pulverizer door, and further wherein said stub shaft can be removed from said plunger can body without having to unbolt said plunger can body from said pulverizer door.

13. The plunger can assembly according to claim 12 further comprising:

a first annular flange approximate to said fore end, wherein said first annular flange seats against a stiffening ring which encircles an opening in said pulverizer door;

a plurality of bores through said first annular flange, said stiffening ring, and said pulverizer door that are aligned with each other and spaced circumferentially around said first annular flange, said stiffening ring, and said pulverizer door; and a plurality of nuts and bolts through said plurality of bores which secure said first annular flange of said plunger can body to said stiffening ring and said pulverizer door.

14. The plunger can assembly according to claim 12 further comprising:

a second annular flange at said fore end having an annular channel formed interior to said second annular flange, and having a plurality of inward extensions on a top side of said second annular flange that are spaced equidistantly around an inside perimeter of said second annular flange.

15. The plunger can assembly according to claim 14 wherein said locking guide further comprises:

an annular lip located on a top side of said locking guide having a plurality of outward extensions on a top side of said annular lip that are spaced equidistantly around an outside perimeter of said annular lip, wherein in an unlocked position, said annular lip of said locking guide fits with clearance within said annular channel, and said plurality of outward extensions and said plurality of inward extensions are offset from each other with clearance; and a plurality of bores spaced circumferentially around said annular lip.

16. The plunger can assembly according to claim 15 wherein said plunger can body further comprises:

a plurality of threaded bores in said fore end of said plunger can body, wherein when said locking guide is rotated about said central axis from said unlocked position to a locked position, said plurality of outward extensions are positioned under said plurality of inward extensions forming a mechanical lock, and said plurality of threaded bores align with said plurality of bores in said annular lip.

17. The plunger can assembly according to claim 16 further comprising:

a plurality of bolts for securing said locking guide to said plunger can body, wherein said plurality of bolts pass through said plurality of bores in said annular lip and into said plurality of threaded bores in said plunger can body and tightened.

18. The plunger can assembly according to claim 12 wherein said stub shaft further comprises:

an annular flange, located on a portion of said stub shaft that is within said plunger can body, which serves as a stop to limit the extent to which said stub shaft can extend out of said aft end of said plunger can body; and a hub above said annular flange on said portion of said stub shaft that is within said plunger can body which snugly receives an aft end of said compression spring.

19. The plunger can assembly according to claim 18 wherein said stub shaft further comprises:

a threaded bore in said hub.

20. The plunger can assembly according to claim 19 wherein said plunger can bushing further comprises:

an annular flange on an end of said plunger can bushing that is within said plunger can body which serves as a stop to limit the extent to which said plunger can bushing can extend through said locking guide and out of said fore end of said plunger can body, wherein said annular flange snugly receives a fore end of said compression spring; and a center bore there through.

21. The plunger can assembly according to claim 20 further comprising:

a blanking plate that attaches to said portion of said plunger can bushing that protrudes out of said fore end of said plunger can body through a plurality of bolts that pass through a plurality of bores in said blanking plate and engage with a plurality of threaded bores in said plunger can bushing, said blanking plate further comprising:

a tap hole in a center of said blanking plate, wherein said tap hole allows a sealer to be injected into an interior of said plunger can body in order to maintain a positive pressure within said plunger can body.

22. The plunger can assembly according to claim 21 further comprising:

a rod for manipulating or retrieving said stub shaft, said rod having a threaded end, wherein said blanking plate is removed and said threaded end of said rod is inserted through said center bore of said plunger can bushing and engaged with said threaded bore of said stub shaft, wherein said stub shaft may be manipulated or removed with said rod without having to remove the plunger can assembly from said pulverizer door.

23. The plunger can assembly according to claim 12 wherein said plunger can body is hollow and cylindrical in shape.

* * * * *